US005366224A

United States Patent [19]

Stanwyck et al.

[11] Patent Number: 5,366,224

[45] Date of Patent: Nov. 22, 1994

[54] MODULAR HOLES FOR A MINIATURE GOLF COURSE AND A METHOD THEREFOR

[75] Inventors: Jon J. Stanwyck, Slinger; Richard T. Haas, Brown Deer, both of Wis.

[73] Assignee: Cost of Wisconsin, Germantown, Wis.

[21] Appl. No.: 950,806

[22] Filed: Sep. 24, 1992

[51] Int. Cl.[5] ..... A63B 69/36

[52] U.S. Cl. ..... 273/176 R; 404/35

[58] Field of Search ..... 273/176, 32 R, 35; 472/92; 404/34, 35, 36, 40, 41, 44; 156/307.5

[56] References Cited

U.S. PATENT DOCUMENTS

| | | | |
|---|---|---|---|
| 1,761,039 | 6/1930 | Hazeltine . | |
| 3,138,387 | 6/1964 | Michel et al. . | |
| 3,735,988 | 5/1973 | Palmer et al. . | |
| 3,885,795 | 5/1975 | Brewer | 273/176 E |
| 3,897,067 | 7/1975 | Smith . | |
| 4,232,494 | 11/1980 | Bauch et al. . | |
| 4,568,584 | 2/1986 | Holland . | |
| 4,600,336 | 7/1986 | Waller, Jr. . | |
| 4,670,079 | 6/1987 | Thompson | 156/307.5 |

FOREIGN PATENT DOCUMENTS

| | | | |
|---|---|---|---|
| 160952 | 11/1985 | European Pat. Off. | 273/176 F |
| 2559175 | 8/1985 | France | 273/176 F |
| 2624027 | 6/1989 | France | 273/176 R |
| 2662089 | 11/1991 | France | 273/176 E |

*Primary Examiner*—Mark S. Graham

*Attorney, Agent, or Firm*—Mason, Kolehmainen, Rathburn & Wyss

[57] ABSTRACT

A golf hole for a miniature golf course is formed of a plurality of modules, each of which has a foam core that is shaped so as to have a contoured top surface to simulate a natural putting green. An anchor is cemented into troughs formed at each corner of each of the modules. While the modules are held together in the configuration of the golf hole, certain exposed outer surfaces of the foam core are covered with glass fiber reinforced concrete and thereafter a finishing coating of cement. The modules are separated and the remaining outer surfaces are finished. The modules and other materials for assembling the hole are packaged into a kit. At the site where the golf course is to be constructed, individual modules are carried and positioned by rods slid through steel loops extending from eyelet bolts threaded into the anchors in each of the modules. After the modules are properly configured, the eyelet bolts are removed and anchoring plates are positioned across the interface between adjacent modules in recesses in the top surfaces of the modules. Screws are threaded into the anchors through holes in the anchoring plates to secure the modules together. A sealing material is spread over the joints between the modules and over the anchoring plates to provide a smooth upper surface. Bricks are affixed along the top, outer periphery of the modules and carpeting is installed over the remainder of the top surface of the hole.

20 Claims, 3 Drawing Sheets

MODULAR HOLES FOR A MINIATURE GOLF COURSE AND A METHOD THEREFOR

BACKGROUND OF THE INVENTION

1. Field of the Invention

The present invention relates generally to miniature golf courses, and, more particularly, to a new and improved, semi-permanent miniature golf course wherein each hole is formed with modular components; to a new and improved method of forming each such hole from such modular components; and to a new and improved kit or package containing the necessary components and instructions so that each such hole can be readily assembled.

2. Description of the Prior Art

Typically holes of a permanent miniature golf course are constructed by pouring concrete into forms that have been laid out in accordance with the configuration of the particular hole. In order to construct holes of the miniature golf course in this manner, the ground on which the hole is to be constructed first is excavated and forms are laid out in conformity with the outline of the hole. Concrete then is poured into the forms. Afterwards, the top surface of the hole has to be properly contoured as the concrete is setting and the concrete is allowed to set in the normal fashion. As can be appreciated, the process of constructing miniature golf courses in this manner is costly. Moreover, it would be difficult, if not impossible, to install such a miniature golf course indoors.

Consequently, it would be advantageous to be able to construct a semi-permanent type of miniature golf course so that the individual holes can be fabricated at a remote site, shipped to the site where the miniature golf course is to be installed, and assembled at that location without the necessity of excavating the ground and pouring concrete at the site where the golf hole is to installed. Additionally, it is desirable to be able to install a miniature golf course indoors as well as outdoors or to be able to remove or relocate the holes of such a miniature golf course if such removal or relocation becomes necessary.

A so-called miniature golf course is disclosed in U.S. Pat. No. 3,138,387. The patent indicates (column 1, lines 14–16) that the golf course can be "easily constructed on a patio, on a lawn or on any suitable site in a relatively small area." In actuality what is disclosed in that patent is a putting green that is formed of a single or integral flooring made "of concrete, relatively thick planking or sheeting" (column 2, lines 54–55). A frame surrounds the outer periphery of the flooring and projects above the flooring to provide an enclosed railing around the putting green to prevent balls from leaving the green. A singular or integral flooring for the green of the type disclosed in the '387 patent is not particularly suitable for use as a hole of a semi-permanent miniature golf course because the size of holes for a miniature golf course does not make it practical to construct the entire hole at a remote site and transport it to the location where the miniature golf course is to be constructed.

A portable golf course is disclosed in U.S. Pat. No. 3,897,067. Each hole of the course is formed from green, fairway and tee sections that are hinged together. As indicated in that patent, the golf course is adapted to be assembled and disassembled indoors or outdoors so that it can be stored when not in use. However, the golf course is not suitable for a semi-permanent installation because it is constructed of "three-eighth inch steel belted reinforced plywood" (column 1, lines 62–65).

A golf practice apparatus is disclosed in U.S. Pat. No. 1,761,039. The putting apparatus disclosed therein includes a plurality of rigid sections joined together by hinges to form the putting surface. The sections are preferably made of wood (page 1, line 37) and hence would not be suitable for a semi-permanent installation. Another practice putting surface is disclosed in U.S. Pat. No. 3,735,988. Separate panels are held together by male fastening projections and female fastening slots located on the sides of modules.

Hence, none of the golf courses or practice apparatus disclosed in these patents provide a structure that would be suitable for holes of a semi-permanent type miniature golf course that can be constructed at a remote location and shipped to and assembled at a different location. In particular, holes of a semi-permanent miniature golf course need to be made so that they are both weather resistant and durable, can be used either indoors or outdoors, and preferably can be constructed and installed in a cost efficient manner.

SUMMARY OF THE INVENTION

Accordingly, it is objects of the present invention to provide a new and improved modular, semi-permanent miniature golf course; to provide a new and improved modular miniature golf course wherein each hole is readily assembled from modular components; to provide a new and improved modular miniature golf course wherein each of the holes can be fabricated of modular components at a remote site and shipped to the site where the miniature golf course is to be assembled; to provide a new and improved miniature golf course wherein each of the holes are formed of modular components that are packaged into a kit so that the hole can be readily assembled at the site where the miniature golf course is to be constructed; and to provide a new and improved method of constructing holes for a miniature golf course from modular components.

In accordance with these and many other objects of the present invention, a miniature golf course embodying the present invention includes a series of individual holes, each of which is formed from modules that are packaged in a kit so that they can be easily shipped and installed. Each of the modules has a foam core that is cut to an appropriate shape by a wire cutter. The top surface of the foam core is contoured so as to simulate natural putting greens of a golf course. In addition, a trough is cut in the foam core adjacent the joint or interface surfaces near each edge of the module and in the case of module containing a cup, a cup hole is formed in the foam core. An anchor is cemented into the troughs and in the case of a module with a cup, a cup is cemented in the cup hole.

After the foam cores for the modules for a particular hole have been formed, jigs are inserted into the anchors in order to secure the foam cores together. The top outer surface of the cut and formed foam core are covered with glass fiber reinforced concrete and thereafter a final coating of cement. The modules then are disassembled, the surfaces are finished, and the modules for the hole are packaged into a kit.

Once the kit is transported to the site where the miniature golf course is to be constructed, a template for the hole is laid out where the hole is to be located. Marking chalk or powder is sprinkled around the edges of the template to form a silhouette of the template. When the template is removed, the chalk or powder forms a hole layout where the modules are to be positioned. The modules can be carried to that location and shifted into place by rods slid through steel loops extending from eyelet portions of eyelet bolts threaded into the anchors in each of the modules. In order to insure that each module is properly positioned with respect to the other modules, each of the modules has indicia on the top surface to aid in positioning the module vis-a-vis other modules forming the golf hole.

After the modules are placed in the hole layout, the eyelet bolts are removed and anchoring plates are positioned across the interface between modules in recesses extending from the mating face of the modules to beyond the threaded anchors. Screws are inserted through holes in the anchoring plates and are screwed into the anchors. When the screws are so tightened, the anchoring plates not only secure the adjacent modules together, but also align those modules. In addition, set screws are threaded into the anchors at the outer corners of the end modules so that the anchor holes are covered when carpeting is installed on the top surface of the modules.

After the modules are positioned and secured together, a sealing material is spread over the anchor plates and the joints between mating faces of the modules so that a smooth upper surface is provided. Bricks can be cemented along the top, outer periphery of the modules and carpeting can be installed over the remainder of the top surface of the hole.

BRIEF DESCRIPTION OF THE DRAWING

These and other objects and advantages of the present invention will become readily apparent upon consideration of the following detailed description and attached drawing, wherein.

DETAILED DESCRIPTION OF THE PREFERRED EMBODIMENT

Figure 1:
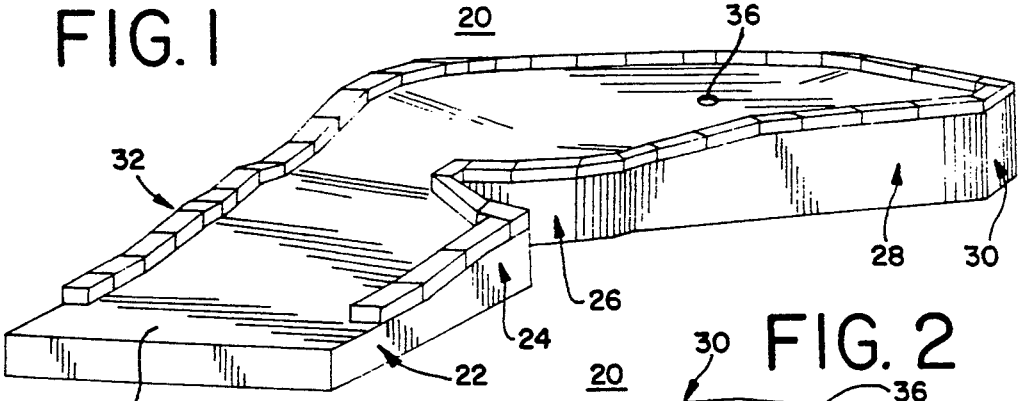
FIG. 1 is a perspective view of a golf hole for a miniature golf course embodying the present invention.
Figure 2:
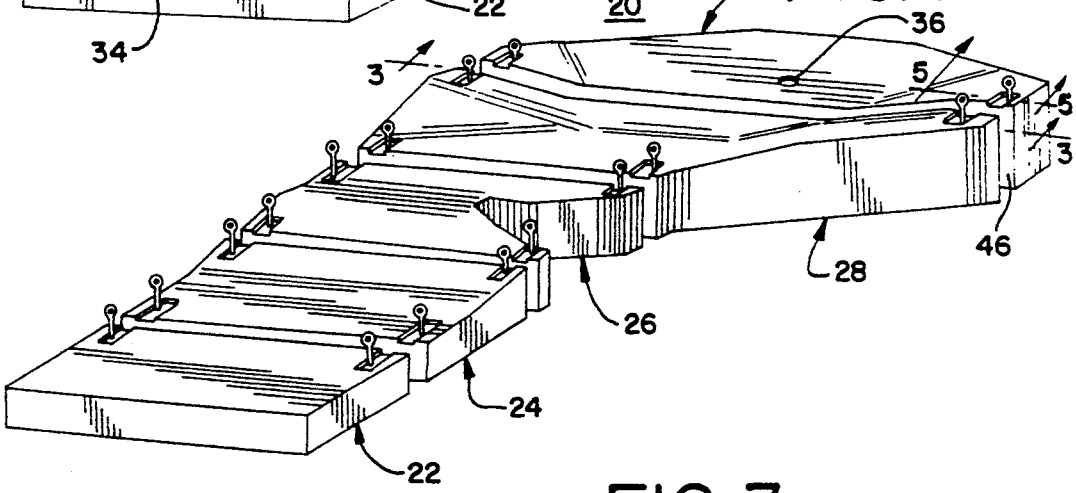
FIG. 2 is a perspective view illustrating the modular components or sections of the golf hole of FIG. 1 prior to assembling the components into the golf hole shown in FIG. 1.

Referring now more specifically to FIGS. 1–2 of the drawings, therein is disclosed a miniature golf course hole generally designated by the reference numeral 20 and embodying the present invention. The golf hole 20 is composed of five modules 22, 24, 26, 28 and 30 that are adapted to be secured together to form the golf hole 20. Once the modules are secured together, bricks 32 or other suitable boundary items may be installed along the outer edges on the top of the modules 22, 24, 26, 28 and 30 so as to provide a frame around the playing surface of the golf hole 20. In addition, a covering or carpeting 34 is installed over the top of the modules 22, 24, 26, 28 and 30 so as to provide an appropriate playing surface for the golf hole 20. The golf hole 20 can be used as one hole of a prefabricated, semi-permanent miniature golf course that can be readily shipped in kits or packages to a site where the golf hole 20 is to be constructed. The fabrication of the components of the golf hole 20 at a factory or the like and the shipment of the components in a kit to the site where the golf hole 20 is to be constructed enables the miniature golf course made of such golf holes 20 to be relatively cost effective. Moreover, the golf hole 20 can be used in an indoor setting as well as in an outdoor setting.

In the disclosed embodiment, the golf hole 20 is formed of the five modules 22, 24, 26, 28 and 30, but typically four to nine such modules are used to form a particular hole. The first module 22 can be considered the tee module or beginning end of the golf hole 20. The module 30 can be considered the final or green module and is located at the other end of the golf hole 20. The tee module 22 and the green module 30 are interconnected by what can be considered fairway modules 24, 26, and 28. The green module 30 contains a cup 36. In some configurations, the fairway module 28 adjacent to the green module 30 also will contain an optional second cup (not shown) like the cup 36.

Figure 3:
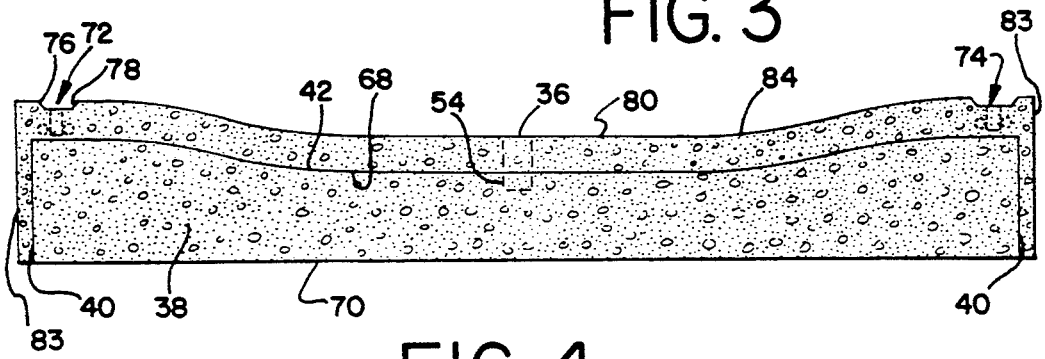
FIG. 3 is a cross sectional view taken along line 3—3 of FIG. 2.
Figure 5:
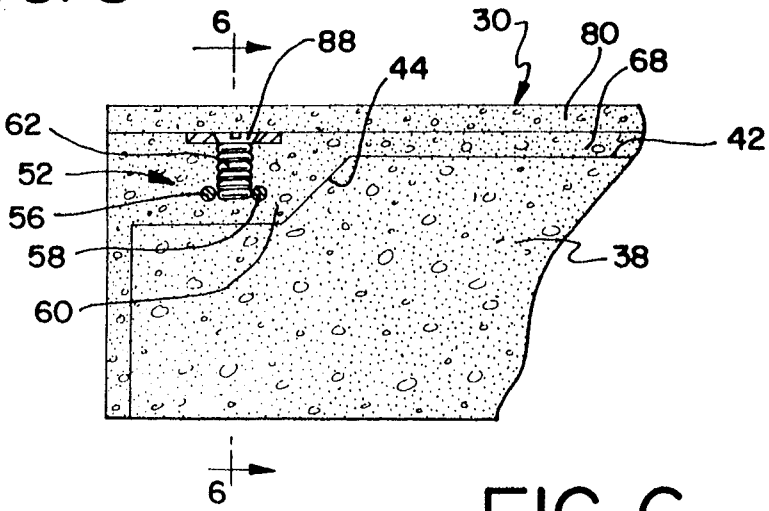
FIG. 5 is a partial cross sectional view taken along line 5—5 in FIG. 2.
Figure 6:
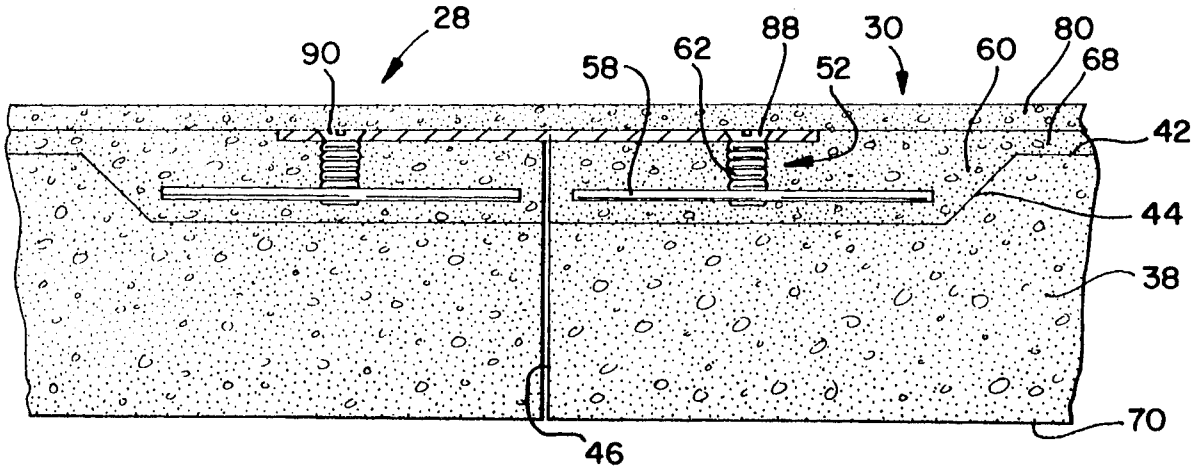
FIG. 6 is a is a partial cross sectional view taken along line 6—6 in FIG. 5.

As is illustrated in FIGS. 3 and 5–6 of the drawings in connection with the module 30, each of the modules 22, 24, 26, 28 and 30 is formed about a foam core 38. The material that may be used for the foam core 38 is any foam type material that can be readily cut to shape. A one pound density expanded polystyrene (EPS) material is particularly suitable for the foam core 38. The foam core 38 is cut by any appropriate cutter, such as a standard wire cutter, so that the shape of the foam core 38 conforms to templates for outer peripheral surfaces 40 and a top surface 42 of the module 30. The foam core 38 typically varies in thickness from three inches to fifteen inches depending upon the contour of the top surface 42 of the module 30 that is being formed. Once the top surface 42 of the foam core 38 has been shaped, a curry comb can be used to further form the top surface 42. The curry comb also provides the top surface 42 of the foam core 38 with a somewhat roughened surface which results in a better surface on which to spray a concrete coating.

A trough 44 is cut in the foam core 38 by a wire cutter or the like near each corner of the foam core 38 such that a total of four troughs are formed in the foam core 38. For example in connection with the module 30 shown in FIG. 6, the trough 44 extends from near a joint or interface surface 46 of the module 30 toward the central portion of the foam core 38. The troughs 44 are adapted to have disposed therein an anchor 52. In the case of a green module, such as the module 30, a cylindrical hole 54 is formed in the foam core 38 by a hole saw or other appropriate tool.

It is preferable to provide the joint surface 46 with additional strength by having a thicker amount of cement coating on the module 30 along the joint surface 46. In order to provide this additional thickness of cement coating, the foam core 38 along the joint surfaces 46 are tapered so that the height of the foam core 38 at the joint surface 46 is about one and one-quarter inch less than the remainder of the foam core 38.

Figure 7:
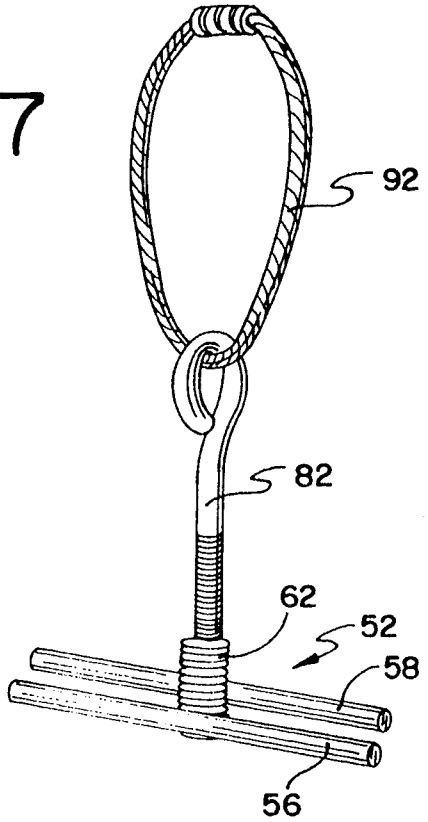
FIG. 7 is a perspective view showing the type of anchor that is embedded in the modules of the golf hole of FIG. 1 with an eyelet having a metal loop therethrough threaded into a ferrule of the anchor.

After all of the foam cores for the modules 22, 24, 26, 28 and 30, such as the foam core 38, have been cut to shape, the anchors, such as the anchor 52 (see FIG. 7), are suspended in the troughs, such as the trough 44 in the case of the module 30, by anchor jigs (not shown) that suspend legs 56 and 58 of the anchors 52 in the troughs 44. With the anchors 52 so suspended in the troughs 44, cement 60 can be poured into the troughs 44 to cover at least the legs 56 and 58 of the anchor 52 and a portion of a threaded ferrule portion 62 which is attached to the legs 56 and 58. In the case of green modules, like the module 30, that include the cup 36, the cup 36 also is placed into the cup hole 54 that was formed in the foam core 38 and cement is poured into the hole 54 to secure the cup 36 in the hole 54. The cement for the anchors 52 and the cup 36 is allowed to set for an appropriate period of time, for example, overnight.

Once the cement for the anchors 52 and the cup 36 sets, the foam cores 38 for the golf hole 20 are placed together with steel templates disposed between the joint faces, such as the joint face 46, and forms around the outer peripheral edges, such as the outer edges 40. The foam cores 38 are maintained properly positioned together by inserting jigs (not shown) into the anchors 52. The jigs include studs that are threaded into the threaded ferrule portion 62 of the anchors 52 and a plate similar to anchor plates, such as anchor plates 64 and 66 illustrated in FIG. 4 of the drawings, that, as will be discussed hereinafter, are used for securing the modules 22, 24, 26, 28 and 30 together.

An approximately one-half inch thick cement coating 68 then is sprayed on the accessible top surfaces 42 of the foam cores 38 of the modules 22, 24, 26, 28 and 30. The cement coating 68 is not applied to the bottom surfaces, such as the bottom surface 70 of the module 30 nor is it applied to the interface or joint surfaces, such as the joint surface 46, because in the final assembly of the golf hole 20, those surfaces are to be held against an adjacent joint surface of the adjoining module.

Any appropriate cement can be used for the cement coating 68. One type of cement that is particularly suitable is a glass fiber reinforced concrete (GFRC). The glass fibers are alkaline resistant so that the GFRC will not be degraded by the joint compound that, as discussed hereinafter, is used to cover the joints between the joint or interface surfaces like the surface 46. Once the cement coating 68 has been so applied to the modules 22, 24, 26, 28 and 30, a nylon or grooved roller can be used to obtain the proper finish on the cement coating 68. While the cement coating 68 is setting, a plastic template (not shown) is forced down over the studs (also not shown) that have been left in the ferrules 62 of the anchors 52 so that a recess flush with the top of the ferrule 62 of the anchor 52 will be formed in the cement coating 68. For example, recesses 72 and 74 are shown in FIG. 3 in connection with the module 30. The recesses 72 and 74 are adapted to receive the anchoring plates 64 and 66 that secure the modules 22, 24, 26, 28 and 30 together. The plastic template can have somewhat tapered or chamfered edges so that the recesses 72 and 74 that are formed have corresponding chamfered or tapering outward edges 76 and 78 that are illustrated in connection with the recess 72 in FIG. 3 of the drawings.

After the cement coating 68 has been allowed to set, a finishing cement coating 80 is sprayed over the coating 68. The finishing coating 80 typically is one-quarter inch to three-eighths inches in thickness. Accordingly, the concrete coating covering the foam core 38 consisting of the coatings 68 and 80 has a total thickness of approximately three-quarter of an inch. However, due to the taper at the joint end of each module, the thickness of the cement coating at the joint surfaces 46 increases to approximately two inches. While this coating 80 is setting, the top surface of each of the modules 22, 24, 26, 28 and 30 can be smoothed and additionally contoured by using trowels and sponges.

After the cement coating 80 has set, the modules 22, 24, 26, 28 and 30 are broken apart and placed on stands (not shown). The modules 22, 24, 26, 28 and 30 can be lifted by inserting eyelet bolts 82 into the ferrule portions 62 of the anchors 52. A splatter coating 83 can be sprayed onto the outer side surfaces 40 of the modules 22, 24, 26, 28 and 30 and the coating 83 can be leveled to provide uniform side surfaces for the modules 22, 24, 26, 28 and 30. A Thoroseal cement compound can be used for the coating 83. In addition, the joint surfaces 46 may be smoothed or finished where necessary.

Figure 8:
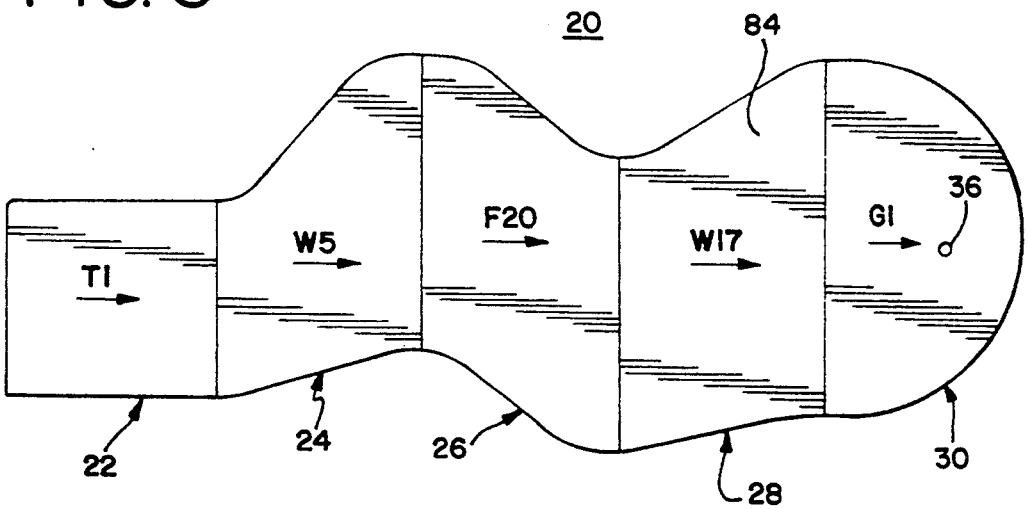
FIG. 8 is a top planar view of the modules of the golf hole of FIG. 1 as they would be assembled into the golf hole of FIG. 1.

Once all of the coatings 68, 80 and 83 have thoroughly dried and set, a coding number is placed on the top surface 84 of the modules 22, 24, 26, 28 and 30 with an arrow pointing in the direction from the tee module 22 toward the green module 30. For example, such coding numbers are illustrated in FIG. 8 of the drawings. The particular code number for each of the modules 22, 24, 26, 28 and 30 designates the height and configuration of the joint sides or edges 46. Different code numbered modules can be placed next to each other as long as the joint configurations are matching. In this regard, the steel templates that are placed between the foam cores 30 for each of the modules 22, 24, 26, 28 and 30 prior to spraying on the cement coatings 68 and 80 insure that the joint surfaces 46 are uniform for each different type of module.

Figure 9:
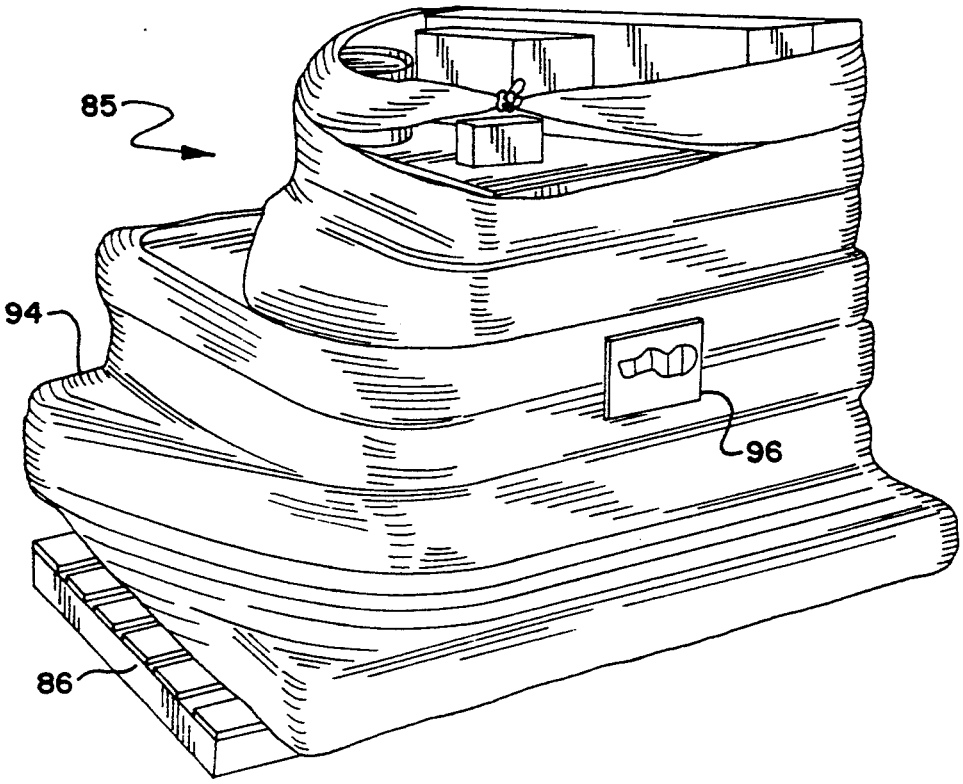
FIG. 9 is a perspective, diagrammatic view of a kit or hole package disposed on a wood pallet, the kit containing the items that are required to assemble the golf hole shown in FIG. 1.

A hole package or kit 85 can be assembled after the modules 22, 24, 26, 28 and 30 for the golf hole 20 have been completed. As illustrated in FIG. 9, the kit 85 is typically placed on a wood pallet 86. The kit 85 can include the modules 22, 24, 26, 28 and 30 that have been configured to form the golf hole 20 (the modules 22, 24, 26, 28 and 30 normally are stacked on the wood pallet 86 with scraps of foam core material placed in between the modules 22, 24, 26, 28 and 30 to cushion and separate the modules 22, 24, 26, 28 and 30 from each other); the anchoring plates, such as the anchoring plates 64 and 66, that are used in securing adjacent modules; set screws, such as set screws 88 and 90 illustrated in FIG. 6, for securing each of the anchors 64 and 66 in the recesses 72 and 74; eyelet bolts, such as the eyelet bolt 82 with metal loops, such as a metal loop 92 illustrated in FIG. 7, that extend through the eyelet portion of the eyelet bolt 82 (the eyelet bolts are adapted to be threaded into the anchors 52 so that the modules 22, 24, 26, 28 and 30 can be readily lifted and properly positioned when the golf hole 20 is assembled); the bricks 32 that are placed on the top surface 84 of the golf hole 20 along the outer periphery of the golf hole 20; the carpeting 34 used in covering the top surface 84 of the modules 22, 24, 26, 28 and 30; joint compound that is spread over the joints between adjacent modules 22, 24, 26, 28 and 30 and around the anchor plates 64 and 66 in order to provide a smooth surface for the installation of the carpeting 34; carpet and brick adhesive for affixing the carpeting 34 and the bricks 32 to the top surface 84; a plastic template sheet that is used for laying out the golf hole 20; chalk or powdered used to form a silhouette from the template; and an Allen wrench for installing the set screws 88 and 90 into the anchors 62. The kit 85 additionally can include an installation video detailing and illustrating how the golf hole 20 is to be assembled; a carpet layout detail showing the best utilization of the carpeting 34; two lifting pipes that can be extended through the wire loops 92 at the corners of a given module so that the module can be readily lifted: and, in some instances, artificial rocks to be used on or adjacent the golf hole 20. Once the package 85 is assembled, the package 85 is enclosed in a plastic covering or wrap 94 so that the kit 85 can be shipped as a unit. A hole outline 96 also may be placed on the outer part of the plastic covering 94 to identify the golf hole 20 and to show the basic outline of modules 22, 24, 26, 28 and 30 and how they are to be positioned. The hole outline 96 may contain an outline similar to the one shown in FIG. 8.

After the golf hole 20 arrives at a site where it is to be assembled, the kit 85 is unpackaged. The template for the golf hole 20 is laid out where the golf hole 20 is to be located. Marking chalk or powder is sprinkled around the edges of the template to form a silhouette of the template. When the template is removed, the chalk or powder forms a hole layout where the modules 22, 24, 26, 28 and 30 are to be positioned. A set of eyelet bolts 82 with the loops 92 therein are threaded into the anchors 52. This enables the modules 22, 24, 26, 28 and 30 to be readily carried to the location for the golf hole 20 and shifted into place by positioning the lifting rods or pipes through the metal loops 92. The hole outline 96 and the indicia on the modules 22, 24, 26, 28 and 30 aid in properly positioning the modules 22, 24, 26, 28 and 30 when the golf hole 20 is being assembled.

Figure 4:
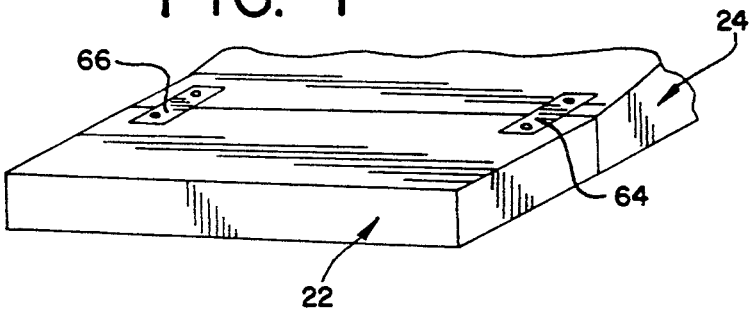
FIG. 4 is a partial perspective view illustrating how individual modules or components of the golf hole of FIG. 1 are secured together so as to form the golf hole of FIG. 1.

After the modules 22, 24, 26, 28 and 30 are placed in their proper positions, the eyelet bolts 82 are removed from the anchors 52. The anchoring plates 64 and 66 are positioned across the interface between adjacent modules in the recesses 72 and 74 as is illustrated in FIG. 4 of the drawings with respect to modules 24 and 26. The set screws 88 and 90 are inserted through holes in the anchor plates 64 and 66 into the ferrules 62 in the anchors 52. The holes in the anchor plates 64 and 66 are somewhat elliptical in shape to allow for slight variations in the centerline to centerline distance between the ferrules 62 in adjacent modules. The heads of the set screws 88 and 90 are chamfered or tapered outwardly so that as the screws 88 and 90 are tightened into the ferrules 62, the adjacent modules are pulled together to provide a tight interface or joint between adjacent modules. The anchor plates 64 and 66 tend to not only secure the adjacent modules together, but also align those modules. In addition, set screws 88 or 90 are threaded into the anchors 52 at the outer corners of the tee module 22 and the green module 30 so that the holes in the ferrules 62 in the anchors 52 are covered when the carpeting 34 is installed on the top surface of the modules 22, 24, 26, 28 and 30.

The joint compound that is used to seal the joints and the anchor plates 64 and 66 may be a Thoroseal joint compound manufactured by Thoroseal Systems Products, Inc. One type of adhesive that can be used in affixing the bricks 32 to the top surface 42 of the modules 22, 24, 26, 28 and 30 is Sure Bond SB 400, manufactured by Sure Bond Inc. In the case of installations that are not to be permanent, the bricks 32 overlying the joint interfaces and/or the anchor plates 64 and 66 can be affixed to the top surface of the modules 22, 24, 26, 28 and 30 with a silicon rubber sealant or caulking such as that made by Dow Corning. Such a compound is used so that the bricks 32 can be removed from above the anchoring plates 64 and 66 when it is necessary to remove the anchoring plates 64 and 66 if the golf hole 20 is to be disassembled.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A hole for a miniature golf course comprising:

a plurality of modules each of which modules being formed of a core having surfaces with at least some of the surfaces including a top surface of said core having a cement coating;

anchoring means disposed in said core to provide a plurality of fastener receiving means in each of said modules:

troughs made in each of said cores that are adapted to have said anchoring means disposed therein, said anchoring means cemented into said troughs so as to retain said anchoring means in said core;

anchoring plate means adapted to extend between adjoining modules to secure said modules together, said anchoring plate means being adapted to fit into recesses in said cement coating on the top of said modules; and fastening means extending through said anchoring plate means into said fastener receiving means of said anchoring means for fastening said anchoring plate means to said modules.

2. A hole for a miniature golf course as set forth in claim 1 wherein each of said modules bears indicia to assist in positioning said module with respect to said other modules.

3. A hole for a miniature golf course as set forth in claim 1 including boundary means that are adapted to be positioned about an outer peripheral edge of said modules and carpeting to be applied to the top surface of said modules.

4. A hole for a miniature golf course as set forth in claim 3 wherein said boundary means includes a plurality of individual bricks that are adapted to be affixed to the top surface of said modules.

5. A hole for a miniature golf course as set forth in claim 1 wherein each of said cores is a foam core made of an expanded polystyrene material.

6. A hole for a miniature golf course as set forth in claim 1 wherein said top surfaces of said cores are contoured to provide a surface that simulates a putting green of a golf course.

7. A hole for a miniature golf course as set forth in claim 1 wherein said cement coating includes glass fiber reinforced concrete.

8. A hole for a miniature golf course comprising:

a plurality of modules each of which modules being formed of a core having surfaces with at least some of the surfaces including a top surface of said core having a cement coating;

anchoring means disposed in said core to provide a plurality of fastener receiving means in each of said modules:

anchoring plate means adapted to extend between adjoining modules to secure said modules together, said anchoring plate means being adapted to fit into recesses in said cement coating on the top of said modules;

fastening means extending through said anchoring plate means into said fastener receiving means of said anchoring means for fastening said anchoring plate means to said modules and;

lifting means that are adapted to be secured into said fastener receiving means so that each of said modules can be lifted.

9. A hole for a miniature golf course as set forth in claim 8 wherein each of said lifting means includes an eyelet bolt having a metal loop extending through the eyelet portion of the eyelet bolt.

10. A hole for a miniature golf course comprising:

a plurality of modules each of which modules being formed of a core having surfaces with at least some of the surfaces including a top surface of said core having a cement coating, each of said cores having at least one interface surface that is adapted to be disposed against an interface surface of an adjoining module, said core being tapered along said interface surfaces such that said cement coating is thicker along said interface surfaces;

anchoring means disposed in said core to provide a plurality of fastener receiving means in each of said modules;

anchoring plate means adapted to extend between adjoining modules to secure said modules together, said anchoring plate means being adapted to fit into recesses in said cement coating on the top of said modules; and fastening means extending through said anchoring plate means into said fastener receiving means of said anchoring means for fastening said anchoring plate means to said modules.

11. A hole for a miniature golf course comprising:

a plurality of modules each of which modules being formed of a core having surfaces with at least some of the surfaces including a top surface of said core having a cement coating, said cement coating including glass fiber reinforced concrete and further including a finishing cement coating applied over said glass fiber reinforced concrete;

anchoring means disposed in said core to provide a plurality of fastener receiving means in each of said modules;

anchoring plate means adapted to extend between adjoining modules to secure said modules together plate means being adapted to fit into recesses in said cement coating on the top of said modules; and fastening means extending through said anchoring plate means into said fastener receiving means of said anchoring means for fastening said anchoring plate means to said modules.

12. A hole for a miniature golf course comprising:

a plurality of modules each of which modules being formed of a core having surfaces with at least some of the surfaces including a top surface of said core having a cement coating;

anchoring means disposed in said core to provide a plurality of fastener receiving means in each of said modules:

anchoring plate means adapted to extend between adjoining modules to secure said modules together, said anchoring plate means being adapted to fit into recesses in said cement coating on the top of said modules, said recesses having chamfered edges; and fastening means extending through said anchoring plate means into said fastener receiving means of said anchoring means for fastening said anchoring plate means to said modules.

13. A hole for a miniature golf course comprising:

a plurality of sections each of which sections having a core with at least a top surface of said core having a cement coating, each of said cores being a foam core made of an expanded polystyrene material with troughs disposed therein;

anchoring means disposed adjacent corners of each of said sections, each of said anchoring means having a threaded aperture and being cemented in said troughs;

plate means adapted to extend between adjoining sections to secure said sections together, said plate means being adapted to fit into recesses that extend in said cement coating from an edge of said section to at least said threaded aperture of said anchoring means; and threaded fastening means extending through said plate means into said threaded apertures of said anchoring means for fastening said plate means to said sections.

14. A hole for a miniature golf course comprising:

a plurality of sections each of which sections having a core with at least a top surface of said core having a cement coating;

anchoring means disposed adjacent corners of each of said sections, each of said anchoring means having a threaded aperture;

plate means adapted to extend between adjoining sections to secure said sections together, said plate means being adapted to fit into recesses that extend in said cement coating from an edge of said section to at least said threaded aperture of said anchoring means;

threaded fastening means extending through said plate means into said threaded apertures of said anchoring means for fastening said plate means to said sections; and lifting means that are adapted to be threaded into said threaded apertures so that each of said sections can be lifted.

15. A hole for a miniature golf course as set forth in claim 14 wherein each of said lifting means includes an eyelet bolt having a metal loop extending through the eyelet portion of the eyelet bolt.

16. A hole for a miniature golf course as set forth in claim 14 wherein each of said sections bears indicia to assist in positioning said section with respect to said other sections.

17. A hole for a miniature golf course as set forth in claim 14 wherein each of said recesses has chamfered edges.

18. A kit for assembling a modular hole of a miniature golf course comprising:

a plurality of modules having a core with at least a top surface of said core having a cement coating, having anchoring means disposed adjacent corners of each of said modules, each of said anchoring means having a fastener aperture, and having recesses that extend in said cement coating from an edge of said module to at least said fastener aperture of said anchoring means;

anchoring plate means adapted to extend between adjoining modules when said modules are placed in a configuration of the hole to secure said modules together, said anchoring plate means being adapted to fit into said recesses;

fastening means that are adapted to extend through said anchoring plate means into said fastener apertures of said anchoring means for fastening said anchoring plate means to said modules; and lifting means that are adapted to be fastened into said fastener apertures so that each of said modules can be lifted and properly positioned in the configuration of said hole.

19. A kit for assembling a modular hole of a miniature golf course as set forth in claim 18 including materials for aiding in the assembling of said modules into said hole.

20. A kit for assembling a modular hole of a miniature golf course as set forth in claim 18 including bricks and carpeting for installation on the top surfaces of said modules after the modules are secured together.

* * * * *

UNITED STATES PATENT AND TRADEMARK OFFICE

CERTIFICATE OF CORRECTION

PATENT NO. : 5,366,224

DATED : November 22, 1994

INVENTOR(S) : JON J. STANWYCK et al

It is certified that error appears in the above-identified patent and that said Letters Patent is hereby corrected as shown below:

Col. 9, line 59, after "together" insert --, said anchoring--.

Signed and Sealed this

Thirty-first Day of January, 1995

*Attest:*

Bruce Lehman

BRUCE LEHMAN

*Attesting Officer*

*Commissioner of Patents and Trademarks*